United States Patent [19]

Ranzanigo

[11] 3,980,372

[45] Sept. 14, 1976

[54] ELECTRICAL SOCKET

[75] Inventor: Pierluigi Ranzanigo, Brescia, Italy

[73] Assignee: Bassani S.p.A., Milan, Italy

[22] Filed: Nov. 5, 1974

[21] Appl. No.: 521,149

[30] Foreign Application Priority Data

Dec. 5, 1973 Italy ..... 306/73

[52] U.S. Cl. ..... 339/41

[51] Int. Cl.[2] ..... H01R 13/44

[58] Field of Search ..... 339/40–44

[56] References Cited

FOREIGN PATENTS OR APPLICATIONS

| | | | |
|---|---|---|---|
| 1,322,939 | 2/1963 | France | 339/41 |
| 1,210,469 | 2/1966 | Germany | 339/41 |
| 870,845 | 6/1961 | United Kingdom | 339/41 |
| 1,210,359 | 10/1970 | United Kingdom | 339/40 |

*Primary Examiner*—Joseph H. McGlynn
*Assistant Examiner*—Craig R. Feinberg
*Attorney, Agent, or Firm*—Michael J. Striker

[57] ABSTRACT

An electrical socket has a safety device comprising a shutter member with at least a pair of lugs engageable by respective pins of an electrical connector plug inserted into the socket. The shutter member has a rest position in which the lugs mask apertures into the body of the socket, thereby to prevent the pins from contacting electrical terminal contacts in the socket. The rest position is defined by the lugs bearing against abutments, and at least one of the lugs is also engaged by its abutment means, to arrest the shutter member in its rest position. The lugs are deflected by the thrust force thereagainst of the pins of the inserted plug, so as to be disengaged from the abutment means. The lugs have inclined surfaces so that said thrust force of the pins will cause displacement of the shutter member to unmask the apertures for insertion of the plug. The shutter member can be a rotary or a linearly displaceable member, and is spring-loaded towards its rest position.

14 Claims, 4 Drawing Figures

ELECTRICAL SOCKET

BACKGROUND OF THE INVENTION

An electrical socket may be provided with a safety device to ensure that an electrical connector plug cannot be inserted into the socket until a shutter member has been displaced to open apertures for receiving the conductor pins of the plug. This safety device is so constructed that the shutter member is moved only if two (or possibly more) of the conductor pins of the plug are inserted simultaneously. Such a safety device is provided in order to prevent possible injury to a person, caused by the improper insertion of a thin electrically conducting member such as a piece of metal wire, a nail, a screwdriver or the like, into one of the socket holes.

One form of such safety device comprises a shutter member which is made in a plurality of parts which are engaged together in the assembled condition within the socket. The shutter member is urged into a position in which it closes the holes for receiving the electrical plug conductor pins, by means of a plurality of springs. The device however is of a generally complex construction, due to the large number of components involved in particular in forming the shutter member, and this in turn results in a high manufacturing cost, not only due to the number of components involved but also because of the requirement for manual labor in assembling the components.

SUMMARY OF THE INVENTION

An object of this invention is to overcome the disadvantages of the above-mentioned safety device in an electrical socket.

Another object of the present invention is to provide an electrical socket having a safety device with the minimum number of components, namely a shutter member and a spring urging the shutter member into an operative position.

Yet another object of the invention is to provide an electrical socket having a safety device with a shutter member, in which the position of the shutter member in which it closes the socket holes through which electric plug conductor pins pass into the socket, is clearly and positively defined.

To achieve the above and other objects, an electrical socket has a safety device with a shutter member which has resiliently flexible lugs. In one position of the shutter member the lugs close respective apertures opening into the body of the socket, such apertures being provided for receiving two (or possibly more) conductor pins of an electrical connector plug to be inserted into the socket. Each of the lugs has an inclined surface such that when the ends of the conductor pins come into abutment thereagainst, the thrust force applied to the lugs by the pins will tend to cause movement of the shutter member into a position such that the pins can be inserted through the apertures into the socket. The lugs are of such a nature that when the conductor pins come into abutment thereagainst, the lugs are flexibly deflected from a rest position in which they co-operate with abutments preventing the shutter member from rotating out of the operative position. Thus, when the lugs are deflected by the conductor pins, the shutter member can then be displaced by the conductor pins coacting on the said inclined surfaces of the lugs to displace the shutter member.

The abutments for arresting the shutter member in its position of closing the conductor pin-receiving apertures can be formed by stationary projections provided on a cover member closing the front of the socket. The projections are preferably of a part-cylindrical configuration, and are coaxial with apertures in the cover for receiving the plug conductor pins. The shutter member may be a rotary member, or it may be displaceable linearly.

DESCRIPTION OF THE PREFERRED EMBODIMENT

Figure 1:
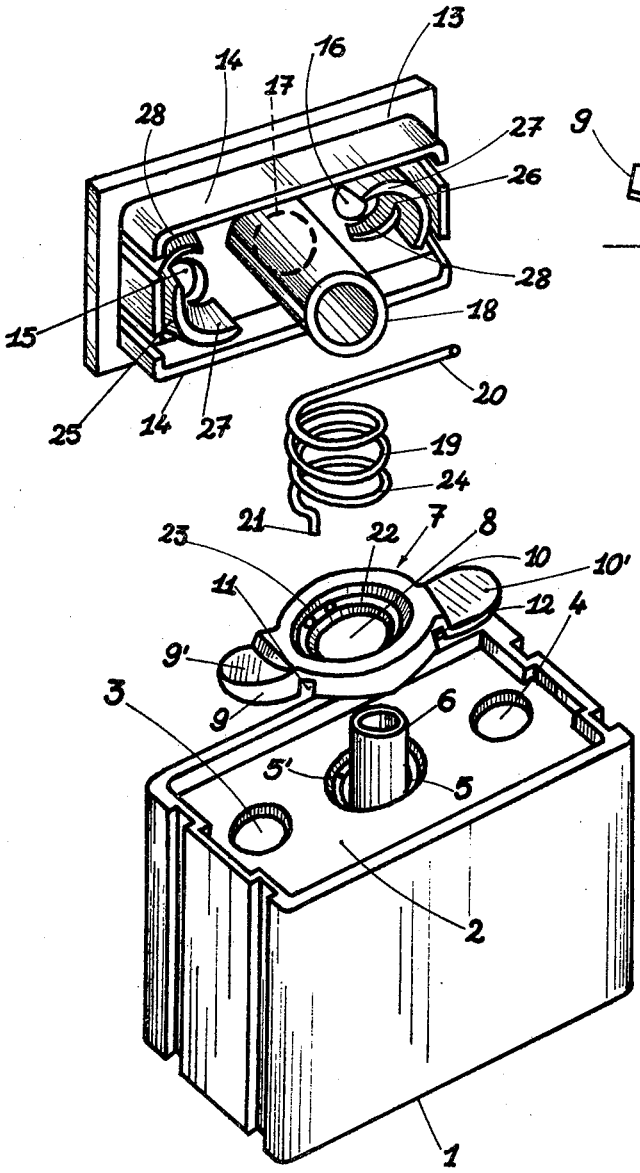
FIG. 1 is an exploded view of an electrical socket showing the various components of a safety device.

Referring firstly to FIG. 1, reference numeral 1 denotes the housing of an electrical socket. The housing is of a generally box-shaped configuration, having two large side walls and two narrower end walls. At the front side of the housing 1 is a front wall 2 which is slightly set back with respect to the front edges of the side and end walls of the housing. The wall 2 has two apertures 3 and 4 through which can pass conductor pins of an electrical connector plug (see FIG. 3). Between the two apertures 3 and 4 the wall 2 has a center aperture 5 for receiving an earthing pin of a connector plug.

Still referring to FIG. 1, a conductor sleeve 6 extends outwardly of the housing through the aperture 5, the sleeve being provided for ensuring electrical contact with the earth pin of the connector plug before the conductor pins of the plug, which are inserted through the apertures 3 and 4, come into contact with contact terminals (not shown) disposed within the housing 1 in alignment with the apertures 3 and 4.

The socket of FIG. 1 has a safety device for preventing improper contact with the contact terminals disposed within the housing 1 of the socket. The safety device includes a shutter member 7 which has a body portion with a large central aperture 8, and at least two laterally projecting lugs or tongue portions 9 and 10. The shutter member 7 is preferably of a resiliently flexible material, for example a plastic such as a thermoplastic material. The lugs 9 and 10 are disposed substantially diametrally opposite to each other with respect to the aperture 8. The shutter member 7 is of such a construction, and positions of he lugs 9 and 10 are such, that the lugs 9 and 10 will mask the apertures 3 and 4 in the wall 2, when the shutter member 7 is in a rest position, as will be described in greater detail hereinafter.

Figure 3:
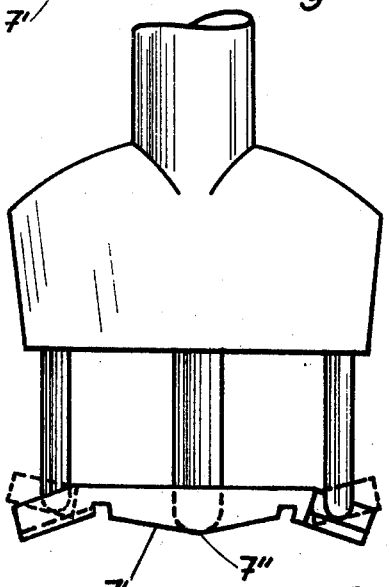
FIG. 3 shows the FIG. 2 shutter member in its position of cooperating with an electrical plug inserted into the socket.

Each of the lugs 9 and 10 is connected to the body portion of the shutter member 7 by way of a connecting portion which has a reduction in thickness, provided by respective grooves 11 and 12 which extend approximately tangentially to but at a spacing from the aperture 8. The grooves 11 and 12 are preferably arranged in the face of the shutter member 7 which faces downwardly in FIG. 1, that is to say, the grooves 11 and 12 open towards the wall 2. As the shutter member 7 is preferably of a flexible material, the lugs 9 and 10 can be deflected towards the wall 2 when the conductor pins of a plug such as that shown in FIG. 3 are brought into abutment against the respective lugs.

Each of the lugs 9 and 10 has a face 9' and 10' respectively remote from the wall 2, and each face 9' and 10' is inclined with respect to the axis of rotation defined by the aperture 8. The two faces 9' and 10' are both inclined in the same peripheral direction, with respect to a given direction of rotation of the shutter member 7, as is clearly visible from FIG. 1. This arrangement provides that when a pushing force is applied against the two faces 9' and 10' of the lugs 9 and 10, such force will result in a force component tending to cause the shutter member 7 to rotate about the axis of the aperture 8, the direction of such rotation being governed by the direction in which the faces 9' and 10' are inclined as aforesaid.

The shutter member 7, when assembled on the housing 1 of the socket, is then covered by a front cover 13. The front face (not visible) of the cover 13 is a flat face, while the other face of the cover 13, that is to say, the major face which is visible in FIG. 1, carries a raised peripherally extending wall 14. The wall 14 will cooperate with the raised front edges of the side and end walls of the housing 1 of the FIG. 1 socket.

The cover 13 has apertures 15 and 16 which, when the cover 13 is fitted into place on the housing 1, are coaxially aligned with the apertures 3 and 4 in the wall 2. The cover 13 also has a central aperture 17, shown in dotted line in FIG. 1, which is coaxial with the aperture 5 in the wall 2.

It will be seen that a tubular sleeve 18 on the cover 13 projects from the face thereof which is towards the housing 1. The sleeve 18 surrounds the aperture 17 so that, when the cover 13, is fitted on the housing 1, the sleeve 18 will engage around the sleeve 6 and partially into the aperture 5 in the wall 2. The aperture 5 includes a shoulder or stepped portion forming an abutment 5' for the free end face of the sleeve 18.

A helical or coil spring 19 is disposed around the sleeve 18, between the inward face of the cover 13 and the adjacent surface of the shutter member 7. An upper end limb portion 20 of the spring 19 extends tangentially with respect to the main body of the spring, and thus extends tangentially of the sleeve 18 and adjacent a part of the wall 14 on the cover 13.

Figure 2:
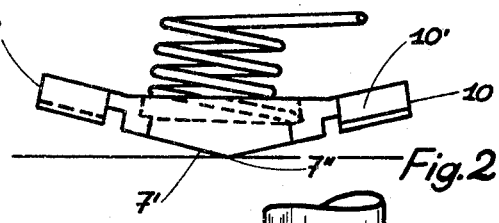
FIG. 2 is a side view of a shutter member of the safety device of FIG. 1.

A lower end limb portion 21 of the spring 19 extends substantially parallel to the axis of the spring 19. When the components of the safety device of FIG. 1 are assembled, the limb portion 21 engages into an aperture 23 in the shutter member 7. More specifically, the aperture 23 is provided in an annular ledge or shoulder 22 formed within the aperture 8 in the shutter member 7; the lowermost coil 24 (as viewed in FIG. 1) of the spring 19 will bear against the shoulder 22. It will be apparent however, that, due to the inclination of the spirally extending coil 24 with respect to the axis of the main body of the spring 19, the coil 24 will impart to the shoulder 22 an eccentric force which will tend to urge the shutter member 7 into an inclined position with respect to its axis of rotation (i.e. the axis of the sleeve 18). Use can be made of this tendency, as shown in FIG. 2, by making the lower face of the shutter member 7, that is to say, the face which bears against the wall 2, of the double-angled configuration shown in FIG. 2. The lower face of the shutter member 7 is thus defined by two faces of which one is denoted at 7' in FIG. 2 and which are inclined with respect to each other. The position at which the inclined faces 7' meet is denoted by reference 7'', and provides a fulcrum about which the shutter member 7 can rock. This rockability of the shutter member 7, combined with the tendency of the shutter member 7 to assume an inclined position due to the aforementioned angle of inclination of the coil 24 of the spring 19, will result in one of the lugs 9 and 10 of the shutter member 7 being disposed slightly higher than the other, that is to say, at a slightly greater spacing from the wall 2 and thus closer to the cover 13. Further reference will be made to this below.

The spring 19 will also apply a turning force to the shutter member 7 for urging the shutter member towards a defined rest position in which the lugs 9 and 10 respectively mask the apertures 3 and 4. The safety device therefore includes means for ensuring that the shutter member 7 has said defined rest position. In the embodiment illustrated, these means for defining the shutter member rest position are provided by projections in the form of two partial sleeves or seats 25 and 26, each of which extends cylindrically partially around a respective one of the two apertures 15 and 16 in the cover 13. Each of the partial sleeves 25 and 26 thus comprises a part-cylindrical wall portion which is coaxial with the respective aperture 25 and 26, the external curved surface of the part-cylindrical wall being directed towards a respective one of the shorter end portions of the wall 14, and the partial sleeves each being open towards the sleeve 18.

Figure 4:
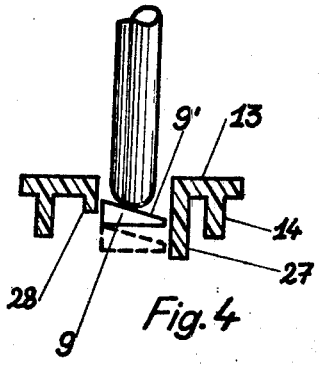
FIG. 4 shows a view in cross-section of one of the pin-receiving apertures in the socket.

Each partial sleeve 25 and 26 is defined by a first wall portion 27 which projects substantially from the surface of the cover 13, and a second wall portion 28 which projects from the surface of the cover 13 to a lesser extent than the above-mentioned wall portion 27 (see also FIG. 4). The lugs 9 and 10 of the shutter member 7 are designed so as to be receivable into the interior of the partial sleeves 25 and 26, with the thicker edge of each of the respective lugs 9 and 10 being directed towards the second wall portion 28 of each of the partial sleeves 25 and 26. The thinner edge of each of the lugs is thus towards the first or higher wall portion 27, and is pressed thereagainst by the force of the spring 19, as referred to above. Thus, the wall portion 27 of each of the partial sleeves 25 and 26 is effective to define the above-mentioned rest position of the shutter member 7.

When the shutter member 7 is in its rest position, at least one of the lugs 9 or 10 will be so positioned relative to the respective sleeve 25 or 26 that the thicker edge of the lug 9 or 10 will abut against the respective wall portion 28, as shown in FIG. 4, due at least in part to the shutter member 7 being urged into a slightly inclined position by virtue of the inclination of the coil 24 of the spring 19, as referred to hereinbefore. This abutment as between a wall portion 28 and a lug such as lug 9 (FIG. 4, in solid lines) will thus prevent the shutter member 7 from being rotated. If a thin member such as a screwdriver, nail or piece of wire is inserted through one of the apertures 15 and 16 in the cover 13, so as to press against the inclined surfaces 9' and 10' of one of the lugs 9 or 10, the respective lug will be deflected downwardly towards the wall 2 and will thus move below the level of the wall portion 28, as viewed in FIG. 4. However, the other lug will not be so depressed, and will therefore abut against the wall portions 27 and 28, to ensure that the shutter member 7 is held in its rest position. In fact, the pressure on just one of the lugs 9 or 10 will cause the shutter member 7 to rock about its fulcrum 7'', so that the other lug will be urged into a position in which it is engaged even deeper into the respective sleeve 25 or 26, thereby further to increase the resistance to rotary movement of the shutter member 7.

If however a connector plug having two conductor pins is to be inserted into the socket, for example a plug as shown in FIG. 3, the two pins will bear simultaneously against the inclined surfaces 9' and 10' of the two lugs. As a result, the two lugs 9 and 10 will both be deflected simultaneously towards the wall 2, such deflection being permitted by the flexibility imparted by the respective grooves 11 and 12. When the lugs 9 and 10 are so deflected, as shown in FIG. 4 in broken lines they will be clear of the level of the respective wall portions 28 of the sleeves 25 and 26. At the same time, the thrust force applied against the inclined surfaces 9' and 10' of the two lugs 9 and 10 will urge the shutter member 7 in rotation about the sleeve 18. This will therefore cause the lugs 9 and 10 to uncover the two apertures 3 and 4, and the plug pins can then be fully inserted into the socket.

It will be noted that the sleeves 26 and 27 are made in one piece with the cover 13, so that the only parts which are separate from the housing 1 and the cover 13 are the shutter member 7 and the spring 19.

Various modifications can be made without departing from the spirit and the scope of the present invention. For example, the shutter member 7 could be displaced, by an inserted plug, with a translatory motion, in contrast to the rotary motion of the shutter member 7 as described above. To provide for such translatory motion, the shutter member could have substantially parallel inclined surfaces which are so directed that the shutter member is moved along or parallel to or at an angle to, for example perpendicularly to, a line joining the apertures 3 and 4 in the socket housing 1.

What is claimed is:

1. In a socket having apertures for receiving pins of a plug, a combination comprising a movable shutter having a central portion located in a general plane and side portions bendable relative to the central portion, said side portions being bendable from a normal first position in which they are located in a first orientation relative to said plane to a bent second position in which they are located in a different second orientation relative to said plane; means mounting the central portion of the movable shutter for movement only transverse to the direction of pin insertion between a blocking position in which the side portions block the apertures and in which the side portions are bendable from the first to the second position by the force of entering pins, and an unblocking position, said side portions being so configurated that pressure exerted upon them in the direction of pin insertion tends to cause the shutter to move from the blocking to the unblocking position; and means for preventing movement of the shutter from the blocking to the unblocking position unless both of the side portions are in the bent second position.

2. A combination as defined in claim 1, wherein said side portions are wedge-shaped and have inclined upper faces adapted to engage the entering pins.

3. A combination as defined in claim 1; and further comprising means for facilitating the bending of the side portions.

4. A combination as defined in claim 3, wherein the facilitating means comprises grooves on the shutter, each of the grooves being located intermediate the central portion and a respective one of the side portions.

5. A combination as defined in claim 1; and further comprising pivot means on the central portion for pivoting the shutter about an axis extending transverse to the direction of pin insertion.

6. A combination as defined in claim 1, wherein said shutter has a generally V-shaped configuration.

7. A combination as defined in claim 1, wherein the socket comprises a housing member, and wherein the mounting means is operative for firmly urging the central portion of the shutter against the housing and thereby preventing movement of the central portion of the shutter in the direction of pin insertion.

8. A combination as defined in claim 7, wherein said mounting means is a spring.

9. A combination as defined in claim 1, wherein the mounting means comprises a coil spring having an axis which is slightly inclined relative to the direction of pin insertion and a lower coil portion engaging the shutter and tending to urge the same into an inclined position wherein one of the side portions has a higher elevation than the other of the side portions.

10. A combination as defined in claim 1, wherein the mounting means mounts the movable shutter for rotary movement about an axis extending in the direction of pin insertion.

11. A combination as defined in claim 1, wherein the mounting means mounts the movable shutter for linear movement in a direction substantially parallel to an axis extending transverse to the direction of pin insertion.

12. A combination as defined in claim 1, wherein the socket further comprises a cover member, and wherein the preventing means are located on the cover member.

13. A combination as defined in claim 1, wherein the socket is an electrical socket having at least two apertures for receiving electrically-conductive pins of an electrical connector plug.

14. In a socket having apertures for receiving pins of a plug, a combination comprising a movable shutter having a central portion and side portions bendable relative to the central portion, each side portion being bendable from a normal first position to a bent second position; means mounting the movable shutter for movement transverse to the direction of pin insertion between a blocking position in which the side portions block the apertures and in which the side portions are bendable from the first to the second position by the force of entering pins, and an unblocking position, said side portions being so configurated that pressure exerted upon them in the direction of pin insertion tends to cause the shutter to move from the blocking to the unblocking position; and means for preventing movement of the shutter from the blocking to the unblocking position unless both of the side portions are in the bent second position, said preventing means comprising half-cylindrical projecting portions which abut the respective side portions of the shutter and thereby prevent movement of the latter from the blocking to the unblocking position.

* * * * *